US007025235B1

(12) United States Patent
DeJonge

(10) Patent No.: US 7,025,235 B1
(45) Date of Patent: Apr. 11, 2006

(54) FLUID DISPENSER WITH ADJUSTABLE SIZE DISPENSING ORIFICE

(75) Inventor: Stuart W. DeJonge, Lake Ariel, PA (US)

(73) Assignee: Valley Design, Inc., Flemington, NJ (US)

( * ) Notice: Subject to any disclaimer, the term of this patent is extended or adjusted under 35 U.S.C. 154(b) by 22 days.

(21) Appl. No.: 10/957,381

(22) Filed: Oct. 1, 2004

(51) Int. Cl.
*B67D 3/00* (2006.01)

(52) U.S. Cl. ..... 222/548; 222/212; 222/521

(58) Field of Classification Search ..... 222/548–549, 222/553, 209, 212–215, 480–481, 142.6, 222/142.7, 142.9, 519–521
See application file for complete search history.

(56) References Cited

U.S. PATENT DOCUMENTS 4,500,016 A * 2/1985 Funfstuck ..... 222/153.14
4,653,672 A * 3/1987 Tuerk et al. ..... 222/153.14
4,699,299 A * 10/1987 Gach ..... 222/480
4,823,994 A * 4/1989 Laauwe ..... 222/521
4,881,666 A 11/1989 Tullman et al.
5,325,999 A * 7/1994 Gueret ..... 222/212
5,505,346 A * 4/1996 Smith ..... 222/505
5,730,322 A * 3/1998 Iba et al. ..... 222/42
5,897,037 A * 4/1999 Mann ..... 222/519
5,975,354 A * 11/1999 Goncalves ..... 222/39
6,318,605 B1 11/2001 Nyman et al.
6,415,965 B1 7/2002 Nyman et al.
6,739,471 B1 5/2004 Goetz et al.

* cited by examiner

*Primary Examiner*—Frederick C. Nicolas
(74) *Attorney, Agent, or Firm*—Kenneth P. Glynn, Esq.

(57) ABSTRACT

A fluid dispenser has an adjustable size dispensing orifice. It includes a fluid dispenser container having a hollow inside for storage of flowable material, the container having a top with a fluid outlet and having an adjustable size dispensing orifice unit connected to the outlet. It also includes the aforesaid adjustable size dispensing orifice unit which has a base member with a dispensing orifice connected to the container, at least one shutter, and a shutter movement ring connected to the shutter and rotatably connected to the base member. The shutter movement ring has a first position and a second position and adapted for rotation to open and close the shutters. The shutter(s) have travel pins that are either integrally formed as part of the shutters or are inserted into a leg of the shutters. The travel pins extend into the shutter movement ring and the base member. One of either the base member and the shutter movement ring has a radiant travel guide and the other has a non-radiant travel guide. Rotation of the ring moves the shutter(s) to open or close.

20 Claims, 5 Drawing Sheets

FLUID DISPENSER WITH ADJUSTABLE SIZE DISPENSING ORIFICE

BACKGROUND OF THE INVENTION

1. Field of the Invention

The present invention relates to a fluid dispenser with an adjustable size dispensing orifice. The dispenser may be gravity-based (invert/flow) or other type of dispenser, but in many preferred embodiments, it is a squeeze dispenser. The device may be used to dispense gels, pastes and other high density materials. It is positively beneficial for dispensing medicine.

2. Information Disclosure Statement

The following patents are representative of unique dispensing arrangements:

U.S. Pat. No. 4,881,666 discloses a container for dispensing carbonated beverages and fluids sensitive to oxidation is provided. The dispenser contains a follower which communicates with the ambient environment through a one-way valve. The dispenser preferably includes a liquid flow rate and a flow velocity regulator to control the rate and velocity at which liquid is dispensed therefrom.

U.S. Pat. No. 6,318,605 B1 discloses a dispenser is provided which includes a container having a closed end that defines an orifice. A closure is mountable about the closed end and has a closing lid portion which includes an orifice plug configured to sealingly engage the orifice. The closure includes a retention collar moveably connected and disposed about an outer surface of the container to facilitate mounting. The closing lid portion is moveably connected to the retention collar. The closure further includes a tamper evident portion that removably connects the closing lid portion and the retention collar to provide a first visual indication. The tamper evident portion is removable to provide a second visual indication. The closed end of the container may have a pair of support posts extending therefrom configured to engage a surface of the closure.

U.S. Pat. No. 6,415,965 B2 discloses a product dispensing system is provided which includes a container having an open end including a neck portion. The neck portion defines an opening. A fitment is configured for mounting with the opening of the neck portion and forming a substantial seal therewith. The fitment defines an orifice. A closure is integrally connected to the fitment and mounted to the open end of the container. The closure includes a closing lid that is flexibly attached thereto. The closing lid includes an orifice plug configured to engage the orifice of the fitment and form a substantial seal therewith. The closure may engage a cavity of the fitment for integral connection therewith. The product dispensing system may include a tamper evident portion.

U.S. Pat. No. 6,739,471 B2 discloses a container, particularly in the form of a beverage can, which has a drinking opening preparation in its upper lid wall, and may be reclosed after being opened by a rotary lid closure. Means are provided for coupling the rotary lid closure to the lid wall when the lid wall recedes somewhat after opening the container so that the drinking opening made can be reclosed sealingly.

Notwithstanding the prior art, the present invention is neither taught nor rendered obvious thereby.

SUMMARY OF THE INVENTION

The present invention is a fluid dispenser with an adjustable size dispensing orifice. It includes a fluid dispenser container having a hollow inside for storage of flowable material, the container having a top with a fluid outlet and having an adjustable size dispensing orifice unit connected to the outlet. It also includes the aforesaid adjustable size dispensing orifice unit. The unit has a base member with a dispensing orifice connected to the container, at least one shutter, and a shutter movement ring connected to the shutter and rotatably connected to the base member. The shutter movement ring has a first position and a second position and adapted for rotation from the first position to the second position and from the second position to the first position. The shutter(s) have travel pins that either integrally formed as part of the shutters or are inserted into a leg of the shutters. The travel pins are located in (extend into) the shutter movement ring and the base member. One of either the base member and the shutter movement ring has a radiant travel guide and the other has a non-radiant travel guide.

A travel guide would be a slot, rail, or other guide to move the travel pin along a predetermined path. A radiant travel guide is one that is close to or is radial (emanated from a center point radial imaginary line). Close to radial would be off center but still moving more in and out than tangential. A non-radiant travel guide is one that is more tangential than radial and intersects with the radiant travel guide.

When the shutter movement ring is rotated from the first position to another position, the travel pins travel linearly and move one shutter(s) linearly along the radiant travel guide and the non-radiant travel guide. Further, when the shutter movement ring is in the first position the shutter fully closes the shutter(s) and the dispensing orifice, and when the shutter movement ring is moved to a position between the first position and the second position, the shutter(s) is partially open, and when the shutter movement ring is moved to its second position, the shutter(s) is fully open.

The present invention fluid dispenser shutter movement ring has the non-radiant travel guide, in some preferred embodiments. This may be an arcuate track for receiving the travel pin, wherein the arcuate track is not concentric with an arc of travel created by the shutter movement ring when rotated from the first position to the second position.

In some preferred embodiments, the present invention dispensing orifice is rectangular and the shutter(s) has a straight line leading edge.

In some embodiments, the present invention shutter leading edge is greater than its distance traveled when the shutter movement ring is moved from the first position to the second position, while in other embodiments, the leading edge is less than its distance traveled when the shutter movement ring is moved from the first position to the second position.

In most preferred embodiments of the present invention fluid dispenser, there are two opposing shutters, each being functionally connected to the shutter movement ring and the base member. It is advantageous for design, assemblage and cost reasons, that the two shutters be identical and be opposingly positioned.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

Figure 1:
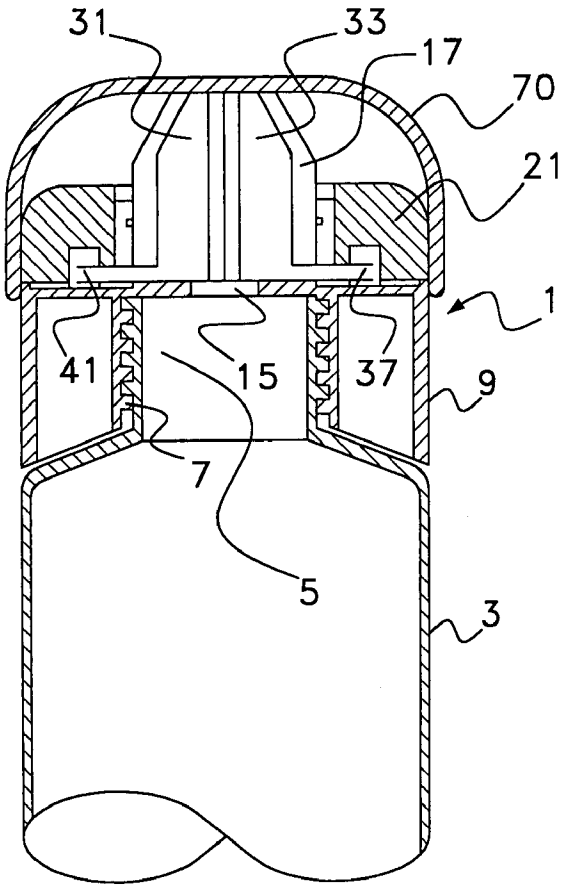
FIG. 1 shows a partial front cut view of a present invention fluid dispenser with an adjustable dispensing orifice in a closed position.

FIG. 1 shows a partial front cut view of a present invention fluid dispenser 1 with an adjustable dispensing orifice in a closed position. Dispenser 1 includes a fluid dispenser container 3 with an open neck 5. Neck 5 includes threads 7 that correspond to the threads of base member 9 (threads 11 of FIG. 6). Base member 9 has a dispensing orifice 15 located at its center top for free flow of container 3 contents. However, shutters 31 and 33 are closed in FIG. 1 and thus prevent contents from being squeezed or poured out of container 3. Shutter movement ring 21 in FIG. 1 is situated in a first position that is a closed position for shutters 31 and 33. Shutters 31 an 33 open and close at right angles to wall 17 (and a second wall, out of the board, not shown). Overcap 70 may be a force fit or a snap cap. A user would remove overcap 70, rotate shutter movement ring 21 to effect separation of shutters 31 and 33 to create a rectangular dispensing opening of a fixed length and variable width. Fluid dispenser 1 may then be tilted or inverted and squeezed to dispense a paste or gel or similar material into a continuous sheet of fixed, desired thickness.

Figure 2:
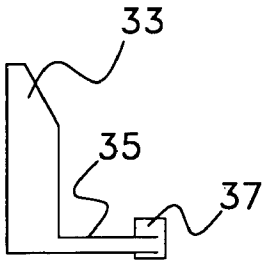
FIG. 2 shows a front view and FIG. 3 shows a top view of one shutter shown in the FIG. 1 present invention device.
Figure 3:
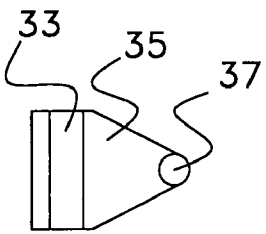

Referring now to FIGS. 2 and 3, FIG. 2 shows a front view and FIG. 3 shows a top view of one shutter 33 shown in the FIG. 1 present invention dispenser 1. Shutter 33 has an upright section as shown, a guide bar 35, and a top travel pin and a bottom travel pin. In this case, both travel pins are established by a single cylinder 37 that projects both upwardly and downwardly to form both a base member pin and a shutter movement ring pin in a single unit. Alternatively, two pins not being coincidental, but one upwardly projecting and the other downwardly projecting, would function effectively.

Figure 4:
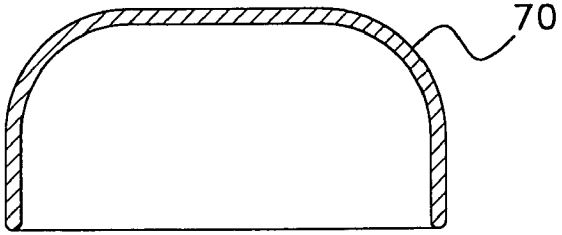
FIGS. 4, 5 and 6 show front cut views of a cap, a shutter movement ring and a base member, respectively, for the present invention device shown in FIG. 1.
Figure 5:
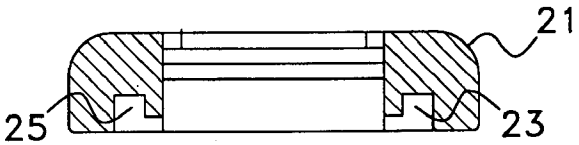
Figure 6:
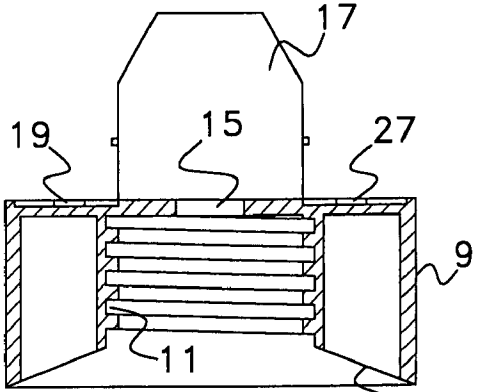

FIGS. 4, 5 and 6 show front cut views of the overcap 70, the shutter movement ring 21 and a base member 9, respectively, for the present invention device shown in FIG. 1. In FIG. 5, shutter movement ring 21 has two curved tracks 23 and 25, here, non-radiant travel guides, adapted to receive the top portions of shutter pins 37 and 41, as shown in FIG. 1. More details of shutter movement ring 21 are discussed below in conjunction with FIGS. 7, 8 and 9.

FIG. 6 shows a side cut view of base member 9 with bottom 13, threads 11, backwall 17, dispensing orifice 15 and radiant travel guides 19 and 27 to receive bottom portions of pins 41 and 37 (see FIG. 1).

Figure 7:
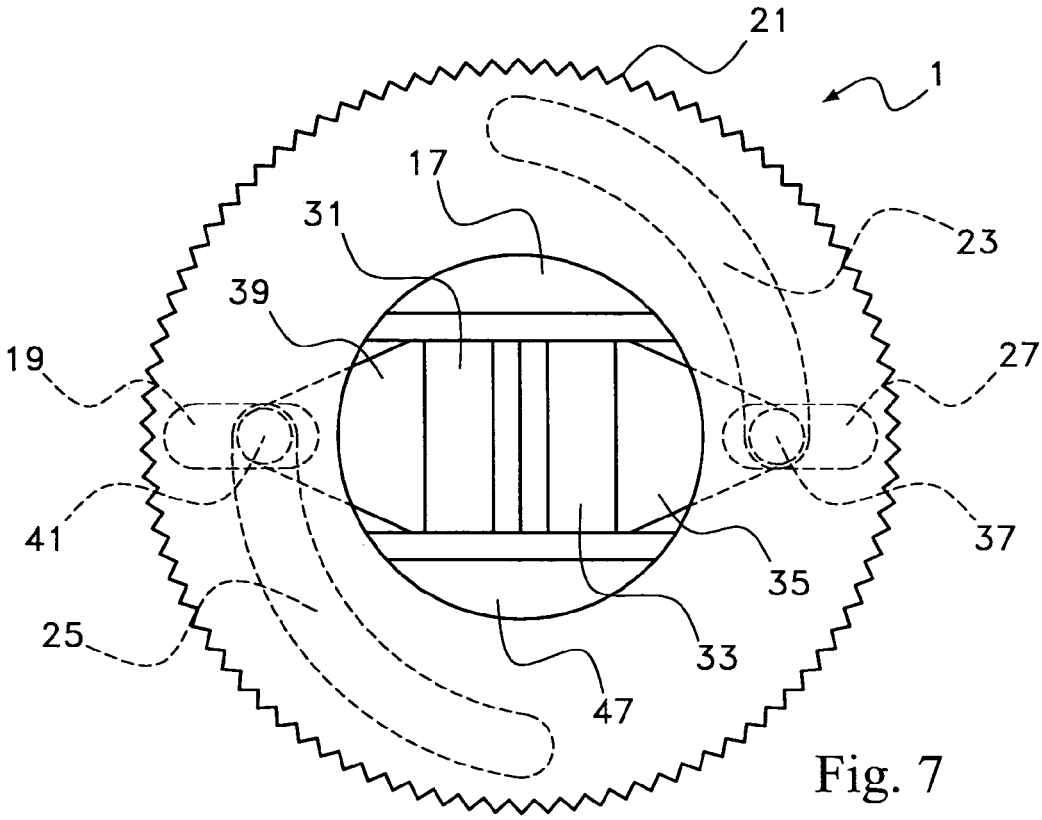
FIG. 7 shows a detailed top view of a present invention device assemblage of the components illustrated in FIGS. 4, 5 and 6 above.
Figure 9:
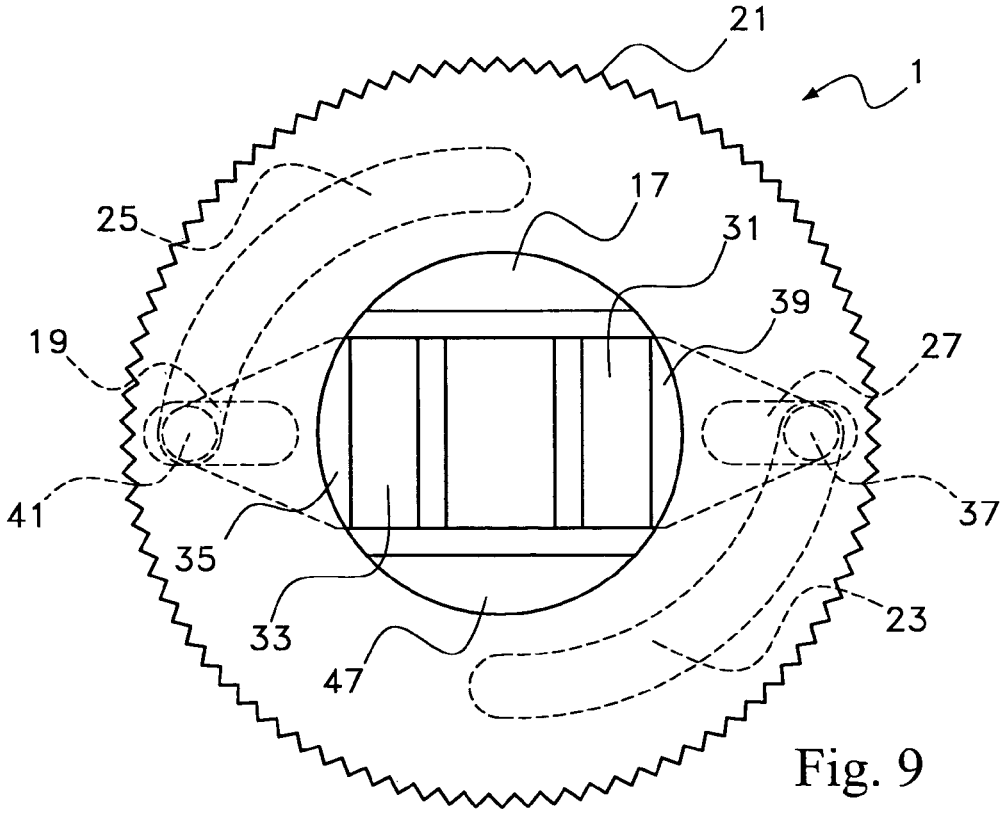
FIG. 9 shows a top view thereof.
Figure 8:
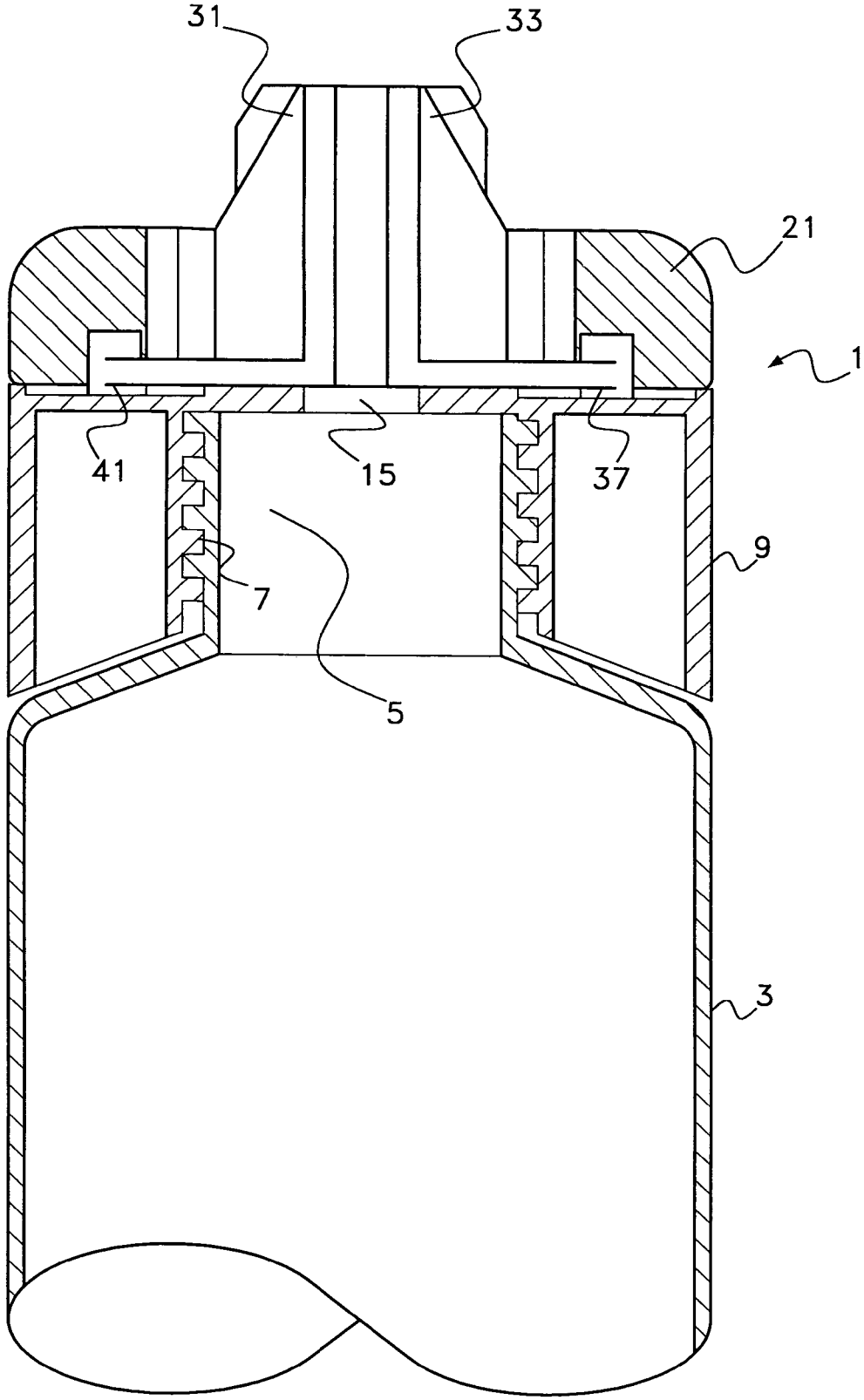
FIG. 8 illustrates a partial cut front view of the present invention FIG. 1 device, but with the shutter (and dispensing orifice) open.

FIG. 7 shows a detailed top view of a present invention device assemblage of the shutters 31 and 33, shutter movement ring 21, and base member 9 illustrated in FIGS. 4, 5 and 6 above. Here, wall 17, already shown above and wall 47 are parallel and maintain shutters 31 and 33 in a fixed path opposing one another. Pins 37 and 41 ride guide tracks 23 and 25 when shutter movement ring 21 is rotated. In FIG. 7, they are in a first, closed position. Note that ride guide tracks 23 and 25 are arcuate but not eccentric to a center point. In other words, they curve outwardly from one end to the other. If shutter movement ring 21 is rotated clockwise, then pins 37 and 41 will end up at the opposite ends as shown in FIGS. 8 and 9. Likewise, pins 37 and 41 are close to center FIG. 7 with respect to base member radiant guides 19 and 27, but are further out in FIG. 9 with shutters 31 and 33 in their open position. Note that FIGS. 7, 8 and 9 have all parts that are also shown in the earlier figures identically numbered and their descriptions need not be repeated here.

Figure 13:
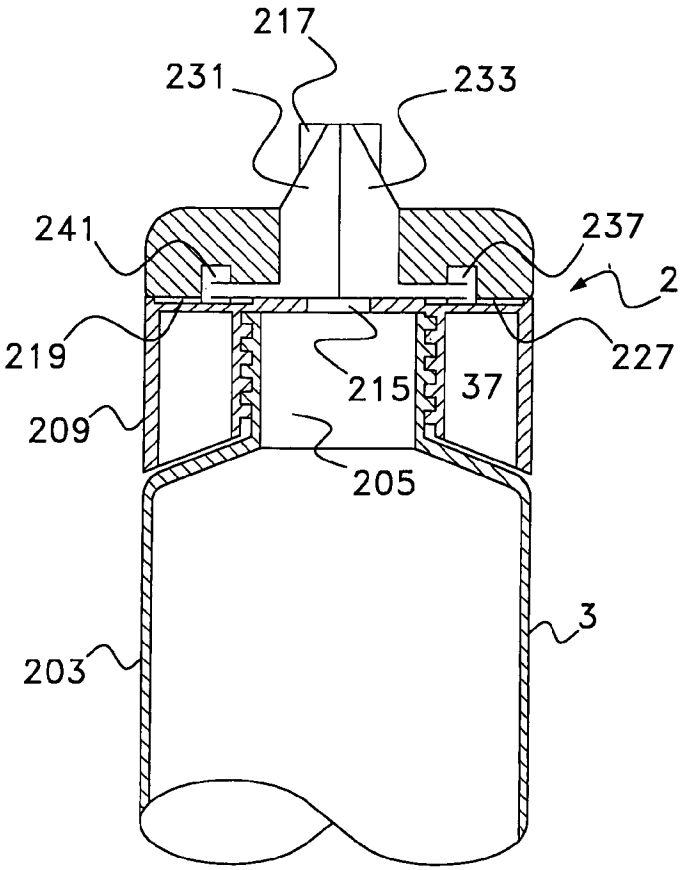
FIGS. 10 and 13 show a open and closed front cut view, respectively of an alternative embodiment present invention device.
Figure 11:
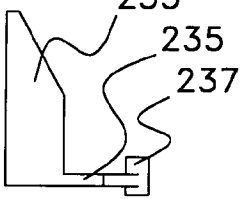
FIGS. 11 and 12 show side and top views of the shutter of FIGS. 10 and 13.
Figure 12:
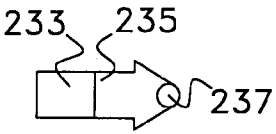
Figure 10:
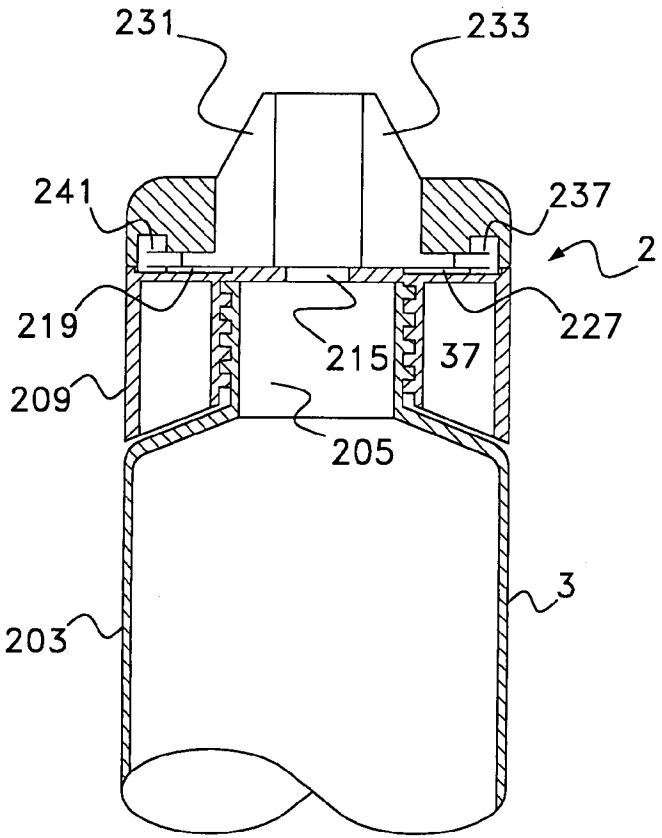

FIGS. 10 and 13 show a open and closed partial front cut view, respectively of an alternative embodiment present invention device fluid dispenser 2, and FIGS. 11 and 12 show side and top views of the shutter 233 of FIGS. 10 and 13. FIG. 10 shows fluid dispenser 2 with an adjustable dispensing orifice in a closed position. Dispenser 2 includes a fluid dispenser container 203 with an open neck 205. Neck 205 includes threads that correspond to the threads of base member 209. Base member 209 has a dispensing orifice 215 located at its center top for free flow of container 203 contents. As shown, shutters 231 and 233 are open in FIG. 10 and closed in FIG. 13. When closed, this prevents contents from being squeezed or poured out of container 203. Shutter movement ring 221 in FIG. 10 is situated in a position that is an open position for shutters 231 and 233. Shutters 231 an 233 open and close at right angles to wall 217 (and a second wall, out of the board, not shown). A user would remove overcap (not shown), rotate shutter movement ring 221 to effect separation of shutters 231 and 233 to create a rectangular dispensing opening of a fixed length and variable width where, in this embodiment, the maximum width is less than or equal to the length. Fluid dispenser 2 may then be tilted or inverted and squeezed to dispense a paste or gel or similar material into a continuous sheet of fixed, desired thickness.

Referring now to FIGS. 12 and 13, FIG. 12 shows a front view and FIG. 13 shows a top view of one shutter 233 shown in the FIG. 10 present invention dispenser 2. Shutter 233 has an upright section as shown, a guide bar 235, and a top travel pin and a bottom travel pin. In this case, both travel pins are established by a single cylinder 237 that projects both upwardly and downwardly to form both a base member pin and a shutter movement ring pin in a single unit. Alternatively, two pins not being coincidental, but one upwardly projecting and the other downwardly projecting, would function effectively.

Figure 14:
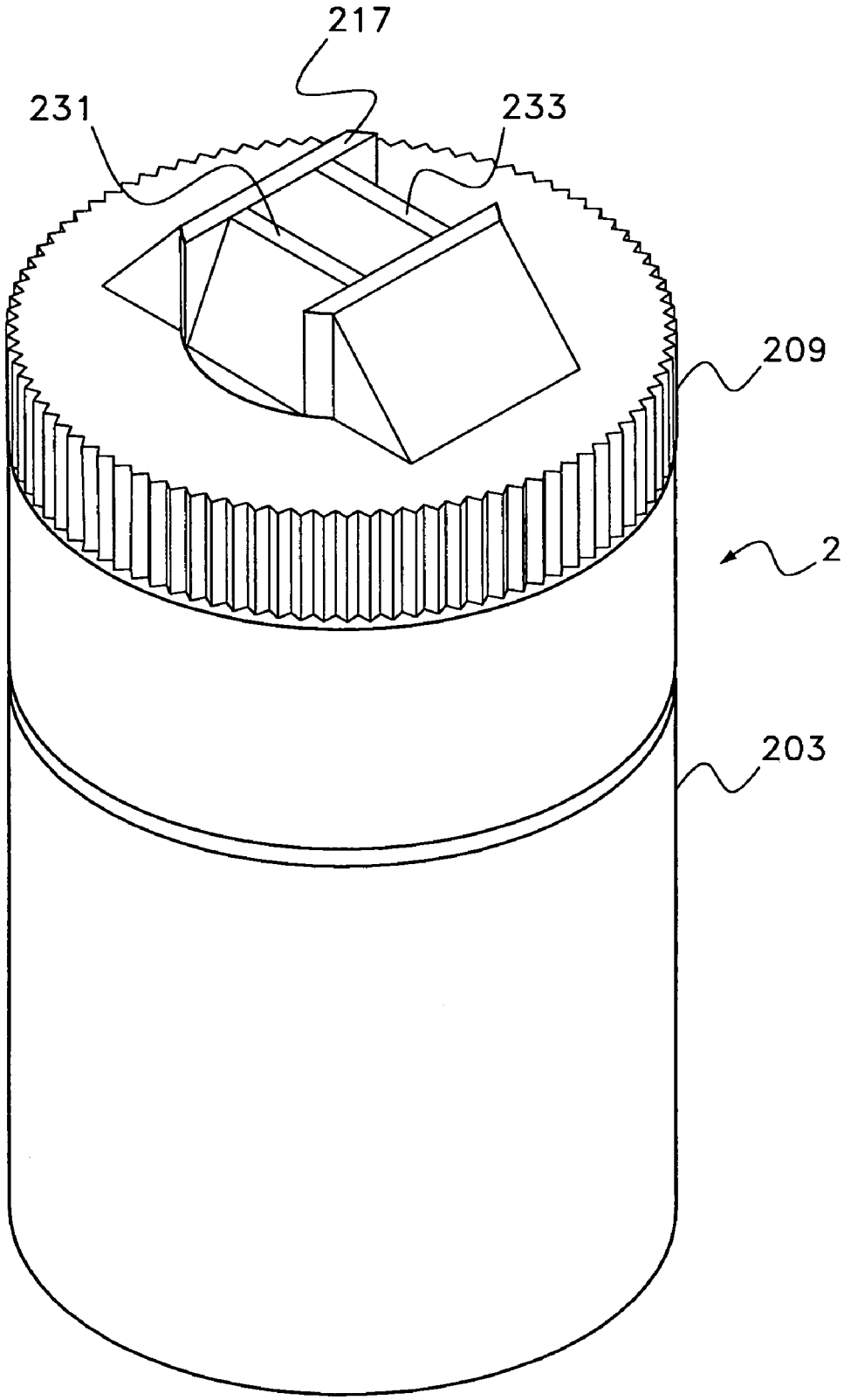
FIG. 14 shows a perspective, top end view of a present invention device to feature one preferred shutter arrangement.

FIG. 14 shows a perspective, top end view of a present invention device 2 to feature the preferred shutter arrangement shown in FIGS. 10, 11, 12 and 13. Identical parts are identically numbered.

Obviously, numerous modifications and variations of the present invention are possible in light of the above teachings. It is therefore understood that within the scope of the appended claims, the invention may be practiced otherwise than as specifically described herein.

What is claimed is:

1. A fluid dispenser with an adjustable size dispensing orifice, which comprises:

(a) a fluid dispenser container having a hollow inside for storage of flowable material, said container having a top with a fluid outlet and having an adjustable size dispensing orifice unit connected to said outlet;

(b) said adjustable size dispensing orifice unit, having a base member with a dispensing orifice connected to said container, at least one shutter, a shutter movement ring connected to said shutter and rotatably connected to said base member, said shutter movement ring having a first position and a second position and adapted for rotation from said first position to said second position and from said second position to said first position, said shutter having travel pins that are located in said shutter movement ring and in said base member, one of said base member and said shutter movement ring having a radiant travel guide and the other having a non-radiant travel guide, such that when said shutter movement ring is rotated from said first position to another position, said travel pins travel linearly and move said at least one shutter linearly along said radiant travel guide and said non-radiant travel guide, and further wherein when said shutter movement ring is in said first position said shutter fully closes said at least one shutter and said dispensing orifice, and when said shutter movement ring is moved to a position between said first position and said second position, said at least one shutter is partially open, and when said shutter movement ring is moved to its second position, said at least one shutter is fully open.

2. The fluid dispenser with an adjustable size dispensing orifice of claim 1 wherein said shutter movement ring has said non-radiant travel guide, which is an arcuate track for receiving said travel pin, wherein said arcuate track is not concentric with an arc of travel created by said shutter movement ring when rotated from said first position to said second position.

3. The fluid dispenser with an adjustable size dispensing orifice of claim 1 wherein said dispensing orifice is rectangular and said at least one shutter has a straight line leading edge.

4. The fluid dispenser with an adjustable size dispensing orifice of claim 3 wherein width of said leading edge is greater than its distance traveled when said shutter movement ring is moved from said first position to said second position.

5. The fluid dispenser with an adjustable size dispensing orifice of claim 3 wherein width of said leading edge is less than its distance traveled when said shutter movement ring is moved from said first position to said second position.

6. The fluid dispenser with an adjustable size dispensing orifice of claim 1 wherein there are two opposing shutters, each being functionally connected to said shutter movement ring and said base member.

7. The fluid dispenser with an adjustable size dispensing orifice of claim 6 wherein said shutter movement ring has two arcuate tracks for receiving at least one travel pin of each of said two opposing shutters, wherein each of said two arcuate tracks are not concentric with an arc of travel created by said shutter movement ring when rotated from said first position to said second position.

8. The fluid dispenser with an adjustable size dispensing orifice of claim 6 wherein said dispensing orifice is rectangular and said at two opposing shutters have a straight line leading edge.

9. The fluid dispenser with an adjustable size dispensing orifice of claim 8 wherein width of said leading edge is greater than its distance traveled when said shutter movement ring is moved from said first position to said second position.

10. The fluid dispenser with an adjustable size dispensing orifice of claim 8 wherein width of said leading edge is less than its distance traveled when said shutter movement ring is moved from said first position to said second position.

11. A fluid dispenser with an adjustable size dispensing orifice, which comprises:

(a) a fluid dispenser container having a hollow inside for storage of flowable material, said container having a top with a fluid outlet and having an adjustable size dispensing orifice unit connected to said outlet;

(b) said adjustable size dispensing orifice unit, having two opposing complementary shutters, an adjusting ring, and a base member with means for attachment to said container, each shutter having travel pins that are connected to said adjusting ring and said base member, said base member having a dispensing orifice such that said adjusting ring is permanently attached to and rotatably connected to said base member, said adjusting ring having a first position and a second position and adapted for rotation from said first position to said second position and from said second position to said first position, wherein said travel pins are connected to said adjusting ring such that when said adjusting ring is rotated from said first position to another position, said travel pins travel linearly and move said shutters linearly outwardly from a center, and further wherein when said adjusting ring is in said first position said shutters fully close said dispensing orifice, when said adjusting ring is moved to a position between said first position and said second position, said shutters are partially open, and when said adjusting ring is moved to its second position, said shutters are fully open.

12. The fluid dispenser with an adjustable size dispensing orifice of claim 11 wherein said adjusting ring has two tracks, one each for receiving one of said shutter's travel pins, wherein said tracks are not concentric with an arc of travel created by said adjusting ring when rotated from said first position to said second position.

13. The fluid dispenser with an adjustable size dispensing orifice of claim 11 wherein said dispensing orifice is rectangular and said at least one shutter has a straight line leading edge.

14. The fluid dispenser with an adjustable size dispensing orifice of claim, 13 wherein width of said leading edge is greater than its distance traveled when said shutter movement ring is moved from said first position to said second position.

15. The fluid dispenser with an adjustable size dispensing orifice of claim 13 wherein width of said leading edge is less than its distance traveled when said adjusting ring is moved from said first position to said second position.

16. The fluid dispenser with an adjustable size dispensing orifice of claim 11 wherein said base member has one of a radiant track and a non-radiant track, and said adjusting ring has the other of a radiant track and a non-radiant track.

17. The fluid dispenser with an adjustable size dispensing orifice of claim 11 wherein said base member has two arcuate tracks for receiving said travel pins of each of said two opposing shutters, wherein each of said two arcuate tracks are not concentric with an arc of travel created by said adjusting ring when rotated from said first position to said second position.

18. The fluid dispenser with an adjustable size dispensing orifice of claim 17 wherein said dispensing orifice is rectangular and said at two opposing shutters have a straight line leading edge.

19. The fluid dispenser with an adjustable size dispensing orifice of claim 18 wherein width of said leading edge is greater than its distance traveled when adjusting ring is moved from said first position to said second position.

20. The fluid dispenser with an adjustable size dispensing orifice of claim 18 wherein width of said leading edge is less than its distance traveled when said adjusting ring is moved from said first position to said second position.

* * * * *